United States Patent [19]

Botkin

[11] 4,051,972

[45] Oct. 4, 1977

[54] CANNING CLOSURE AND METHOD

[76] Inventor: Albert L. Botkin, 3018 Hood Ave., Chicago, Ill. 60659

[21] Appl. No.: 691,564

[22] Filed: June 1, 1976

Related U.S. Application Data

[63] Continuation-in-part of Ser. No. 572,160, April 28, 1975, Pat. No. 3,967,746.

[51] Int. Cl.[2] ..... B65D 51/16

[52] U.S. Cl. ..... 215/260; 215/329; 215/331; 426/131; 426/407

[58] Field of Search ..... 215/260, 261, 262, 270, 215/271, 329, 331; 426/118, 131, 395, 407

[56] References Cited

U.S. PATENT DOCUMENTS

| | | | |
|---|---|---|---|
| 1,574,085 | 2/1926 | Hammer | 215/331 |
| 2,046,227 | 6/1936 | White | 215/262 |
| 2,449,014 | 9/1948 | Shaffer | 215/260 |
| 3,160,302 | 12/1964 | Chaplin | 215/271 |
| 3,589,545 | 6/1971 | Carpenter | 215/260 |

FOREIGN PATENT DOCUMENTS

| | | | |
|---|---|---|---|
| 236,093 | 10/1959 | Australia | 215/348 |
| 1,084,564 | 9/1967 | United Kingdom | 215/261 |

*Primary Examiner*—Donald F. Norton
*Attorney, Agent, or Firm*—Dressler, Goldsmith, Clement, Gordon & Shore, Ltd.

[57] ABSTRACT

A one-piece reusable closure for home canning. The closure is adapted for sealing home canning containers, such as "Mason Jars." The closure has a one-piece threaded cap with a bonded annular closed-cell foam gasket at the periphery of the central cover section positioned to seal against the jar lip. A central cover portion is dished outwardly and moves to an inwardly dished configuration when a partial vacuum is developed in the container. When the closure is unscrewed, the central cover section springs with an audible click to the outwardly dished configuration. The closure incorporates a stop mechanism to limit the extent of gasket compression by limiting the threaded engagement of the closure with the container. The mechanism can comprise either a deformed thread groove or a lower edge of the closure adapted to abut a flange on the container when the desired gasket compression is achieved. The compression of the gasket material against the lip of the container is thus limited to a predetermined degree. As the container contents are heated with the gasket so compressed against the lip of the container, gases will be vented under the gasket; however, upon subsequent cooling of the container contents and formation of a partial vacuum therewithin, the closure seals the container to maintain the partial vacuum. The closure may be initially fully tightened and need not be further tightened after heating and subsequent cooling of the container to maintain the seal and partial vacuum within the container.

21 Claims, 8 Drawing Figures

CANNING CLOSURE AND METHOD

CROSS-REFERENCE TO RELATED APPLICATION

This application is a continuation-in-part application of may application Ser. No. 572,160, filed Apr. 28, 1975, now U.S. Pat. No. 3,967,746.

BACKGROUND OF THE INVENTION

This invention relates to an improved closure for food containers, and particularly to those used for the home canning of foods, and to a method of canning using that closure.

Many types of containers and closures for the home canning of food products have been developed over the years. For many years, the most prevalent home canning medium in the United States has been the so-called "Mason Jar." Such a medium usually comprises a glass container having a standardized external thread on the periphery of the mouth and a suitable cap or closure assembly. Most recently, a widely used two-piece closure assembly has comprised a dished, disc-shaped central cover panel having an annular gasket formed at its periphery on one surface and a threaded peripheral portion. The threaded peripheral portion has a depending skirt or flange with a suitable thread, cooperable with the glass container thread, and an annular shoulder adapted to overlie the upper periphery of the gasketed central cover panel. The threaded peripheral portion is usually loosely threaded on the container after the central cover panel has been positioned over the mouth and prior to heating. The threaded peripheral portion is usually left loose enough so that, as the contents are heated, venting of gases may take place under the gasket. Thereafter, as the container cools the central cover panel seals against the container lip, following which the threaded peripheral portion is tightened so that when the container is stored, vacuum will be positively maintained. When the cover panel is of the dished type, as the container cools, the panel snaps into an inwardly dished position. Other systems for sealing home canning containers have used separate rubber sealing gaskets or rings, and the like.

All of the various media and methods for sealing home canning containers have one or more drawbacks. Some systems require separate and separable sealing elements, such as rubber gaskets or rings. Others require elaborate positive locking mechanisms. The most commonly used system usually requires the use of an implement to remove the sealed central cover panel from a container. Such removal damages the gasketed central cover panel and therefore requires it to be discarded after a single use.

In my copending parent application Ser. No. 572,160, filed Apr. 28, 1975, an invention is disclosed relating to a one-piece reusable closure for home canning. The closure comprises a threaded lid with a bonded annular closed-cell foam gasket at the periphery of a central portion of the lid for confronting and sealing against a jar lip. To provide a means for gas to escape from the jar during heating in the canning process, the gasket is designed to be compressed by the gas pressure to permit venting of the gas between the jar lip and the gasket. To insure that the gasket will always have a suitable compression capability, special limitor projections extend from the periphery of the central portion of the lid, at spaced intervals, downwardly into the gasket and compress the gasket material against the jar lip to control tightening of the lid on the jar. This leaves circumferentially spaced portions of the gasket between the limitor projections in a less compressed state and therefore capable of further compression by increased gas pressure to provide venting as necessary.

It has now been found that limitation of the compression of the gasket can be achieved in other novel ways.

SUMMARY OF THE INVENTION

In accordance with this invention a one-piece, reusable closure for home canning containers is provided. It effectively seals the container, prevents blow-out of the gasketing material under rapid decompression and provides a positive visual indication that vacuum has been maintained in the container. In its preferred form, the maintenance of the vacuum is indicated not only visually, but also audibly upon the opening of the sealed container.

An additional safety feature provided in accordance with this invention is the presence of a novel limitor means for controlling the degree to which the closure may readily be tightened on the glass container. With closures of preferred embodiment of the present invention, the one-piece closure may be screwed down, as to its final tightness, which is controlled by container engaging limitor means. The gasket and closure configuration is such that the gasket is suitably resilient to compress under excessive internal pressure to allow gases to be vented, as when the container is being heated, and so that when the internal pressure is relieved, the gasket will relax, again to seal against the container lip, thereby to allow the container to maintain an internal vacuum.

A package in accordance with this invention comprises a glass container having a body portion and an upwardly-extending threaded neck portion which terminates in a mouth which presents an upper circumferential sealing lip. The package further comprises a one-piece closure which is sealingly secured to the container. The closure comprises a central cover section terminating outwardly in an integral depending peripheral flange or skirt having a thread in threaded engagement with the container thread. An annular gasket formed of a closed-cell foam material is bonded to the closure adjacent the skirt, and is in sealing engagement with the lip around its entire peripheral edge. A portion of the central cover section is dished and is maintained in an inwardly dished configuration by subatmospheric pressure in the sealed package. When the closure is unscrewed to gain access to the contents of the container, the central cover portion springs preferentially to an outwardly dished configuration.

Limitor means are provided to prevent over-tightening of the closure and over-compression of the gasket material to the point where gases cannot vent therethrough. Preferably such limitor means are formed in the skirt of the closure. In one embodiment, the limitor means comprises a deformed portion of the closure skirt thread providing a threading stop for abutment with a leading portion of the container thread. In another embodiment, a portion of the lower edge of the closure skirt abuts a circumferential flange on the glass container. In either case, the closure is prevented from being screwed further onto the container and thus, the gasket is compressed only to a predetermined extent.

A method of home canning in accordance with this invention comprises the steps of filling a container with a desired quantity of product to be canned, threadingly securing a one-piece closure of this invention to the container with the gasket in sealing engagement with the container lip, and then, while heating the container, permitting gases present within the sealed container to break the seal between the gasket and the container by compressing the gasket so as to vent under the gasket to the surrounding atmosphere, and thereafter, while cooling the container, re-effecting the seal between the gasket and the lip without further manipulation of the closure, thereby to allow a subatmospheric pressure or vacuum to develop in the container. The central cover section of the closure defines a normally outwardly dished central cover portion which is drawn into a downwardly dished configuration as the pressure within the container decreases below atmospheric pressure upon cooling, thereby visually indicating that the container contents are under a subatmospheric pressure.

Numerous other advantages and features of the present invention will become readily apparent from the following detailed description of the invention and of one embodiment thereof, from the claims and from the accompanying drawings in which each and every detail shown is fully and completely disclosed as a part of this specification.

DESCRIPTION OF THE PREFERRED EMBODIMENT

Figure 1:
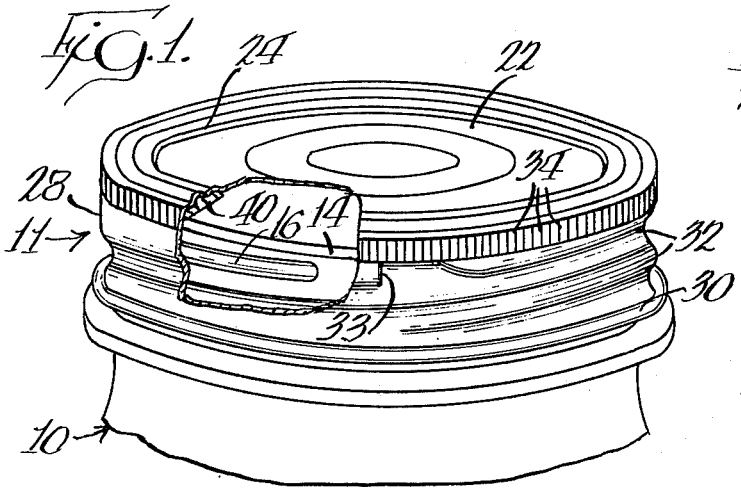
FIG. 1 is a fragmentary perspective view of a closure partially threaded on a glass jar container and showing the lead end of the container thread in the proximity of a deformation provided in the closure thread, a portion of the closure being broken away to better show interior detail.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

In the following description, two digit numerals are used to refer to the embodiments illustrated in FIGS. 1–5, three digit numerals in the one hundred series are used to refer to the embodiment illustrated in FIGS. 6 and 7, and three digit numerals in the two hundred series are used to refer to the embodiment illustrated in FIG. 8. The same last two digits in each numeral designate similar or functionally analogous elements in the various embodiments.

Figure 3:
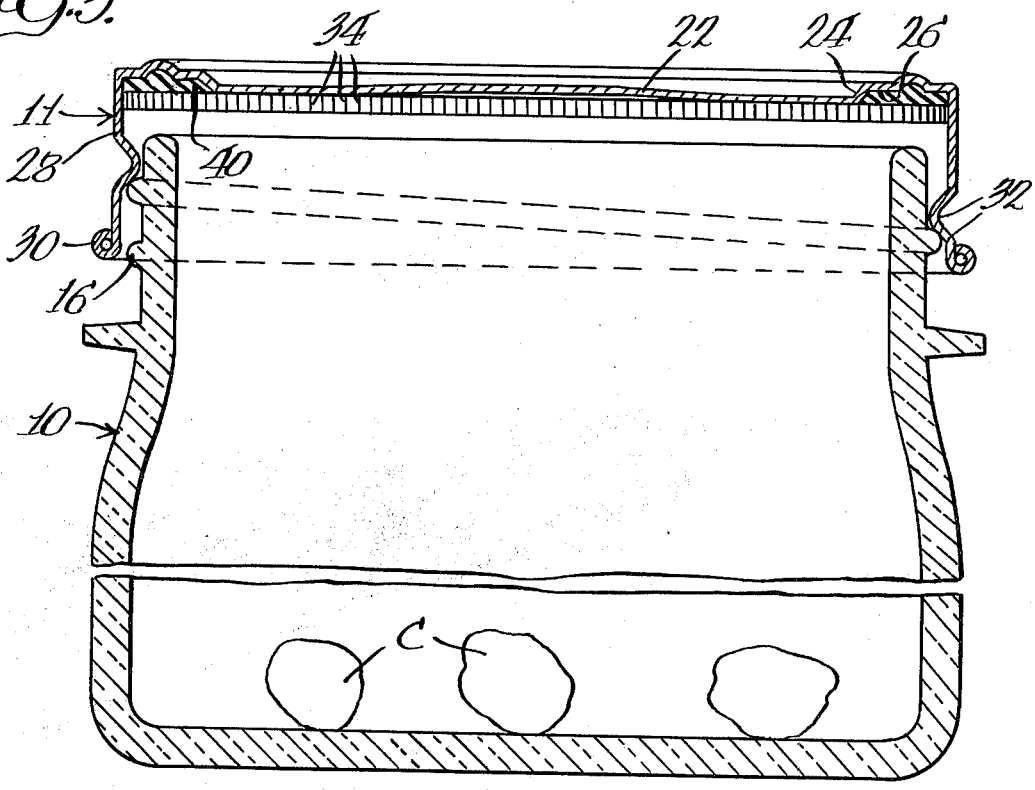
FIG. 3 is a partial cross-sectional view, with the closure partially threaded on a glass jar container containing food pieces.

Referring now to FIGS. 1 and 3 which illustrate a presently preferred embodiment of this invention, a package comprising glass container 10 proportioned to cooperate with one-piece reusable closure 11 of this invention is provided. Container 10 has a body portion and an upwardly-extending neck portion presenting mouth 12 surmounted by an upper, circumferential sealing bead or lip 14. Helical thread 16 adapted to engage with a complementary closure thread is provided on container 10 just below lip 14.

A one-piece reusable closure 11 of this invention is provided for closing mouth 12 via a gasket which sealingly engages lip 14. Closure 11 may be metallic, as of steel, tinplate or aluminum, and comprises a central cover section 22 which is bounded by annular shoulder 24. The central cover section defines a central cover portion which is domed or outwardly dished. Under partial vacuum the central panel portion is drawn into an inwardly dished configuration. When partial vacuum is relieved, the central portion preferentially springs back to the outwardly dished configuration of FIG. 3. Shoulder 24 borders an inverted, downwardly opening annular gasket receiving channel 26 which terminates at its outer edge in a depending peripheral skirt 28. A rolled edge bead 30 is provided at the lower edge of skirt 28.

Figure 4:
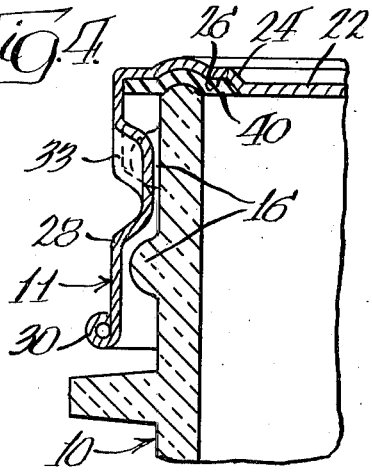
FIG. 4 is a partial cross-sectional view, taken along the plane 4—4 of FIG. 2 with the closure thread deformation abutting the lead end of the container thread.
Figure 2:
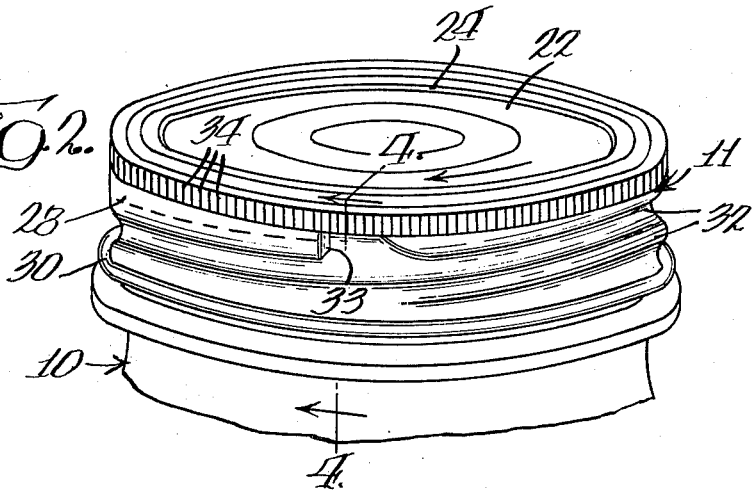
FIG. 2 is a fragmentary perspective view, similar to FIG. 1, showing the closure and container top in sealingly threaded engagement with each other and with the closure thread deformation abutting the lead end of the container thread (shown dashed)

Depending skirt 28 is suitably formed to provide helical skirt thread 32 proportioned to threadingly engage container thread 16 of container 10. A portion of helical thread 32 is deformed so as to widen the thread groove at one point to provide threading stop 33. Threading stop 33 functions as a limitor means for limiting the degree of gasket compression by limiting the extent of threaded engagement between container thread 16 and closure skirt thread 32. FIG. 1 shows the closure 11 partially threadingly engaged with container 10. Threading stop 33 is spaced away from the leading end portion of container thread 16. FIG. 2 shows closure 11 threadingly engaged with container 10 to the maximum extent possible. Here the extent of threaded engagement is limited by threading stop 33 abutting the leading end portion of container thread 16. FIG. 4 shows the cross-section view, taken along line 4—4 of FIG. 2, of the deformation of the groove of closure skirt thread 32. The increased width of the groove in the deformed area of the thread presents in effect an abutment against the leading end of container thread 16. Although thread 32 is illustrated as a continuous thread, it will be apparent that a suitable segmental or interrupted thread of a known type can also be utilized.

The uppermost portion of depending skirt 28 may be formed with a plurality of corrugations 34 of conventional size and shape to facilitate gripping of the closure for securing it with, and for removing it from, container 10.

Channel 26 is filled with a suitable sealing material which serves as resilient gasket 40. The gasket material is preferably a foamed material of the closed-cell type. It may consist of a polyvinyl chloride plastisol, such as of the type described in U.S. Pat. No. 3,005,433. Such materials may be foamed, as by the addition of a suitable quantity of a gas generating material, such as a blowing agent sold by E. I. du Pont de Nemours Co. under the designation "Nitrosan." A suitable blowing agent may comprise a mixture of 70% N,N'-dimethyl-N,N'-dinitrosoterephthalamide and 30% white mineral oil, a mixture which liberates nitrogen gas at 100° C. Foamed plastisols of this type have previously been used for closures of different construction that those of the present invention, such as two-piece canning closures of the type referred to above and one-piece closures which are not intended for use as a vacuum pack closures.

To provide suitably bonded gasket, the metal closure is first coated with a suitable primer, following which the plastisol with the added blowing agent is applied, as in an annular pattern. Following its application, the plastisol is heated to expand and cure in situ and to form a strong, secure bond with the closure, thereby integrating it with the one-piece reusable closure of this invention. It has been determined that the volume of plastisol used may be expanded by the blowing agent by from about 10% to about 50%, and preferably from about 20% to about 40%, thereby to provide a bonded foamed gasket of closedcell material which is resilient at elevated temperatures up to about 250° F. and suitable for use with the closure of this invention.

As best seen in FIGS. 2 and 4, threading stop 33, while controlling the extent to which closure 11 may be tightened onto container 10, limits the compression of foam gasket 40 in channel 26 against lip 14 to a predetermined degree.

Figure 5:
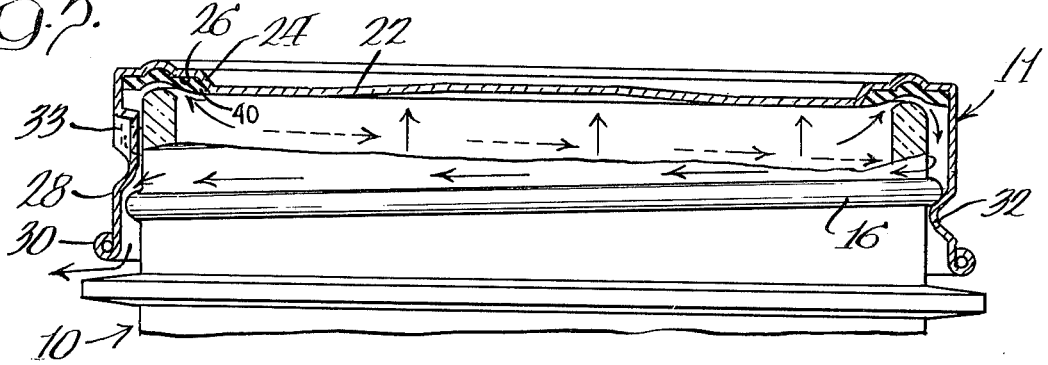
FIG. 5 is a partial cross-sectional view with the closure threaded on the container in sealing engagement and with the contents of the container under superatmospheric pressure.

When a closure 11 is to be sealingly secured to container 10, thereby to seal the contents C of the container therewithin, as shown in FIG. 3, the container is first filled as desired. The closure 11 is then juxtaposed, as illustrated in FIG. 3 with mouth 12 of container 10 and is then screwed down, as illustrated in FIGS. 2 and 4, until gasket 40 sealingly engages lip 14 around the entire lip. The degree to which the closure 11 may be tightened onto container 10 is controlled by threading stop 33. When closure 11 is screwed down, it partially compresses the underlying foam gasket portion so that, under elevated internal pressure, gases may vent under the gasket. When closure 11 has been sufficiently tightened, the contents C of container 10 are heated to safeguard them against spoilage. As the internal pressure increases, it reaches a level at which it acts against the resilient foam gasket to further compress it, as illustrated by FIG. 5, thereby breaking the seal to vent gases, and to allow the gases to escape from the container to the surrounding atmosphere. The presence of threading stop 33, which limits the compression of foam gasket 40 at lip 14, serves to control the degree of gasket compression, and to make certain that internally developed pressure will further compress the gasket and will vent to the ambient atmosphere.

After heating has been completed and is discontinued, the internally developed container pressure decreases as the container cools. As this occurs, gasket 40 will again engage lip 14, re-effecting the seal between the gasket and the lip, without further manipulation of the closure. As further cooling occurs, a partial vacuum is developed in the container. When a partial vacuum of approximately two to four inches of water is reached, the outwardly domed portion of central cover section 22 is pulled inwardly to an inverted domed position. The movement of the portion of central cover section 22 from the outwardly dished portion to the inwardly dished position is accompanied by an audible click-type sound. As long as subatmospheric pressure, i.e., partial vacuum, is maintained within the container, the portion of the central cover section will remain in the inverted, domed or dished position, thereby providing a visual indication that the formed seal is maintained. When the closure is unscrewed to gain access to the contents of the package, gasket 40 will be moved away from its sealing engagement with lip 14. That will permit air to enter the container, equilibrating internal pressure with that of the ambient atmosphere, and will then permit the dished portion of the central cover section 22 to return to the up-position of FIG. 5. Of course, if the container is removed from storage and the closure is found to be domed upwardly, that condition serves as a visual indication that the contents may be spoiled and should not be used.

The precise nature of the venting and sealing capability of the gasket is dependent on the actual materials and structural dimensions. However, some general principles can be noted. When the closure is threadingly engaged with the container to the maximum extent as allowed by the threading stop, a certain amount of pre-compression of the gasket is then present. This pre-compression presents an initial force that must be overcome in order for internally developed gas pressure to raise the gasket off of the container lip for venting. The gasket, when so pre-compressed, presents an impediment to through flow in either direction.

For proper operation with the home canning process, the gasket pre-compression must be overcome during the heating state when gas pressure within the container is increased. The gasket pre-compression, at least in some region, must thus be less than the force of the container's interior gas pressure upon the gasket area in that region (i.e., force = gasket area × gas pressure) encountered during the heating state. Note that the pressure on the gasket during the heating stage is the result of a differential pressure—the internal container pressure (greater than atmospheric) minus the external container pressure (atmospheric).

However, during the cooling (vacuum generation) stage the opposite effect is encountered and must be accomodated. For proper operation with the home canning process, the gasket must remain sealed on the container lip and prevent air ingress. As the cooling stage begins, the gasket is, of course, still under the amount of pre-compression originally applied. During the cooling (vacuum) stage, the pressure within the container becomes subatmospheric. The exterior atmospheric pressure then acts on the lid to further compress the gasket, at least to the extent permitted by the flexibility of the lid and by looseness, if any, in the thread engagement. This futher enhances the seal and, in fact, would create a sufficient vacuum seal in the absence of any pre-compression. Note that the potential in-leakage pressure on the gasket during the vacuum stage is the result of a differential pressure—the external container pressure (atmospheric) minus the internal container pressure (a partial vacuum—less than atmospheric). But, in-leakage cannot occur if the in-leakage pressure drop under the gasket were to exceed the pressure difference between the exterior and interior of the container.

It has been found that closures can be made in accordance with this invention which will remain sealed under differential pressures of about 25 inches of mercury or less. Thus, partial vacuums of this magnitude can be achieved. However, at larger pressure differentials and at superatmospheric pressure within the container, the gasket is further compressed to permit through flow of gaseous fluid. Thus, during the home canning heating stage, internal container gas pressures of substantially greater than about 25 inches of mercury (but well below the pressure required to rupture the container) are vented and relieved. Since some amount of the new gases which are generated during the heating stage are vented to atmosphere, the subsequent cooling of the container will create a partial vacuum as determined by application of Dalton's Law to the remaining molar contents of the constituent gases.

With respect to the current two-piece closures, it is to be observed that when the contents of a sealed container are to be used and the container is to be opened, the peripheral closure portion must first be unscrewed and removed. That leaves the gasketed central cover section in sealing engagement with the container. An implement must then be used to pry up the panel, thereby to break the seal with the gasket. This usually damages or destroys the gasket, making the cover panel non-reusable. The closure of this invention is removable as a unit simply by unscrewing it, without extraneous implements and without damage to the gasket, thereby making it reusable.

Figure 6:
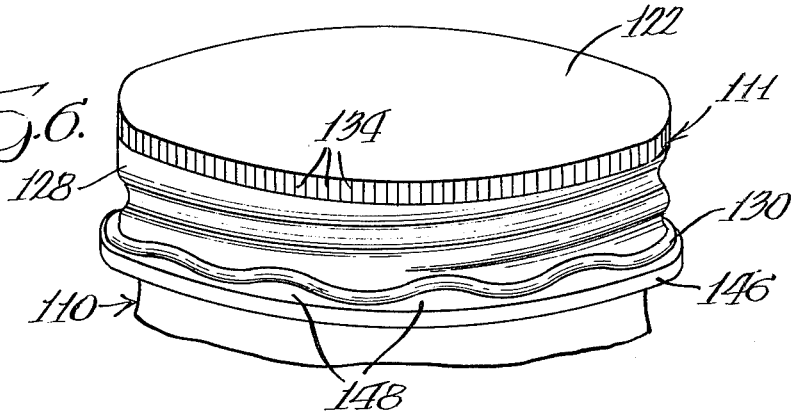
FIG. 6 is a perspective view of another embodiment of this invention showing a closure in threaded engagement with a container, and having an undulating skirt edge abutting a peripheral flange on the container.
Figure 7:
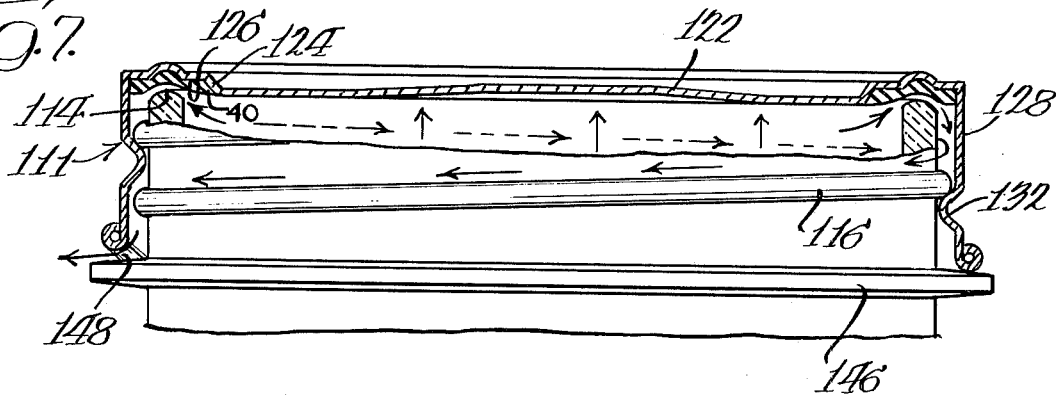
FIG. 7 is an enlarged cross-sectional view of the container and closure of FIG. 6 with the closure threaded in sealing engagement with the container and with the contents of the container under superatmospheric pressure.

Another embodiment of this invention is shown in FIGS. 6 and 7. Here closure 111 is threadingly engaged on container 110. Container 110 has circumferential flange 146 below helical container thread 116. Closure 111 has central cover section 122 and depending peripheral closure skirt 128 which incorporates helical thread 132 for engaging container thread 116. Rolled bead 130 on the bottom edge closure skirt 128 is shaped to present an undulating surface in intermittent abutment with circumferential flange 146. Spaces 148 between bead 130 and flange 146 provide communication between the outside of closure 111 and the inside of closure skirt 128 avoiding the possibility of forming a seal between the bead and the flange and the possibility of pressure build up at this juncture. The portions of bead 130 which contact flange 146 function as a limitor means to limit the extent of threaded engagement between container 110 and closure 111. The remaining structural features of closure 111 are analogous to those described above for the embodiment shown in FIGS. 1 through 7. Foam gasket 140 is disposed within channel 126 for effecting a seal with lip 114 of container 110 when closure 111 is screwed onto container 110. The compression of gasket 140 between lip 114 and channel 126 is limited to a predetermined degree by the abutting relation between bead 130 and flange 146. The degree of gasket compression is predetermined to permit venting of gases at, or above, a certain internal container pressure. As shown in FIG. 7, at a certain pressure level, the gases break the seal between gasket 140 and lip 114 and vent to atmosphere along container threads 116 between the outside surface of container 110 and the inside surface of closure 111. The gases exit through spaces 148 between flange 146 and undulating bead 130.

Figure 8:
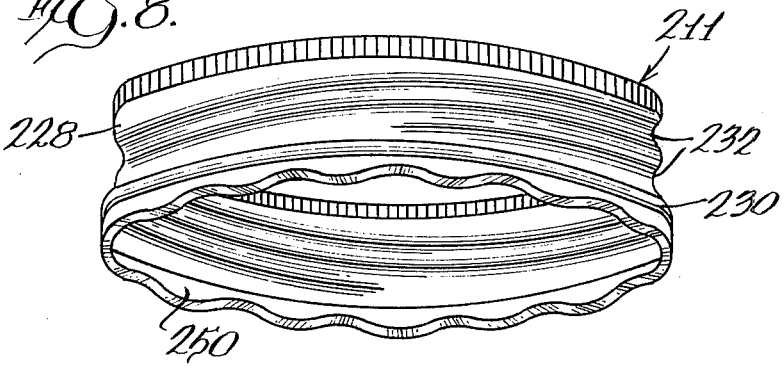
FIG. 8 is a perspective view of another embodiment of this invention showing a closure with a resilient undulating closure skirt edge.

Another embodiment of the invention is shown in FIG. 8. Closure 211 is used in a manner analogous to that shown for closure 111 in FIGS. 6 and 7. However, closure 211 has a uniform, rolled rigid bead 230 near the bottom edge of skirt 228. Secured to rigid bead 230 is a resilient bead 250 presenting an undulating surface for abutting a flange on a container with which closure 211 can be engaged. Closure 211 is otherwise identical in form and function to closure 111 of FIGS. 6 and 7.

Resilient bead 230, being itself somewhat compressible, is compressed more or less by the container flange in accordance with manufacturing variations or dimensional tolerances for the distance between the container lip and container flange. Variations in this distance are "absorbed" by the greater or lesser compression of resilient bead 230. In this manner, the distance variations are transmitted to a mitigated degree to the top of closure 211. Thus, the variation of the compression of the foamed gasket in the closure top is reduced to an amount less than would be experienced with a rigid bead/flange interface.

It will be apparent that the one-piece closure of this invention provides a number of advantages. Although but a few embodiments have been illustrated, those skilled in the art will appreciate that the closure and the method of using it may take a variety of forms. Accordingly, I intend to be limited only insofar as the appended claims shall require.

I claim:

1. A sealed package under vacuum comprising a container having a body portion and an upwardly-extending neck portion which terminates in an upper circumferential sealing lip and defines a mouth; helical container thread means on the outer surface of said neck portion; and a one-piece reusable closure threadedly engaging said neck portion and sealingly secured to said container; said closure comprising a central cover section having an inner surface and an outer surface and terminating outwardly in a depending peripheral skirt having a helical skirt thread means complementary to and in threaded engagement with said container thread means, an annular gasket comprising a resilient, compressible closed cell foam resilient at temperatures up to about 250° F. bonded to the inner surface of said closure adjacent to said skirt and being in sealing engagement with, and compressed against, said lip around the entire periphery of said lip, and limitor means displaced from said gasket for limiting the compression of said gasket material against said lip to a predetermined degree.

2. A sealed package under vacuum comprising a container having a body portion and an upwardly-extending neck portion which terminates in an upper circumferential sealing lip and defines a mouth; helical container thread means on the outer surface of said neck portion; and a one-piece reusable closure threadedly engaging said neck portion and sealingly secured to said container; said closure comprising a central cover section having an inner surface and an outer surface and terminating outwardly in a depending peripheral skirt having helical skirt thread means complementary to and in threaded engagement with said container thread means, an annular gasket comprising a resilient, compressible closed cell foam resilient at temperatures up to about 250° F. bonded to the inner surface of said inner surface of said closure adjacent to said skirt and being in sealing engagement with, and compressed against, said lip around the entire periphery of said lip, and limitor means in said skirt thread means for limiting the extent of threaded engagement with said container thread means whereby compression of said gasket material against said lip is limited to a predetermined degree.

3. The sealed package in accordance with claim 2 wherein said central cover section defines a downwardly opening, annular channel adjacent said skirt; wherein said annular gasket is disposed in said annular channel; and wherein said limitor means is a deformation in said skirt thread means.

4. The sealed package in accordance with claim 2 wherein said limitor means comprises an inwardly projecting vertical wall portion of said skirt thread means to provide a threading stop upon abutment with a leading portion of said container thread means.

5. The sealed package in accordance with claim 2 wherein said central cover section is dished and is in an inwardly dished configuration when pressure within the sealed package is subatmospheric and is capable of springing preferentially to an outwardly dished configuration when pressure within the sealed package is at least atmospheric.

6. A one-piece reusable closure for a container having a body portion and an upwardly extending neck portion which terminates in an upper circumferential sealing lip and defines a mouth and having helical container thread means on the outer surface of said neck portion, said closure comprising: a central cover section having an inner surface and an outer surface and a depending peripheral skirt having helical skirt thread means for threadingly engaging the container thread of a container; an annular gasket comprising a resilient, compressible closed cell foam resilient at temperatures up to about 250° F. at the periphery of said central cover section, said gasket being bonded to said central cover section for confronting the periphery of a said sealing lip; limitor means displaced from said gasket for limiting the extent of threaded engagement with said container thread means whereby compression of said gasket against said lip is limited to a predetermined degree; and a portion of said central cover section being outwardly dished, but being movable, under gas pressure to an inwardly dished configuration and capable of generating an audible sound upon movement.

7. The one-piece reusable closure in accordance with claim 6 wherein said limitor means is in said skirt.

8. The one-piece reusable closure in accordance with claim 6 wherein said closed-cell foamed material is a foamed plastisol.

9. A sealed package under vacuum comprising a container having a body portion, a circumferential flange extending outwardly from said container, and an upwardly-extending neck portion which terminates in an upper circumferential sealing lip and defines a mouth; helical container thread means on the outer surface of said neck portion above said flange, and a one-piece reusable closure threadedly engaging said neck portion and sealingly secured to said container; said closure comprising a central cover section having an inner surface and an outer surface and terminating outwardly in a depending peripheral skirt having helical skirt thread means complementary to and in threaded engagement with said container thread means, an annular gasket bonded to the inner surface of said closure adjacent to said skirt and being in sealing engagement with said lip around the entire periphery of said lip, said gasket comprising closed-cell foam material resilient at temperatures up to about 250° F., and limitor means integral with said skirt and adapted to abut said circumferential flange for limiting the extent of threaded engagement by said closure with said container thread means whereby compression of gasket material against said lip is limited to a predetermined degree.

10. The sealed package in accordance with claim 9 wherein said central cover section defines a downwardly opening, annular channel adjacent said skirt; wherein said annular gasket is disposed in said annular channel; and wherein said limitor means comprises a surface defined by at least a portion of said skirt which abuts said circumferential container flange.

11. A sealed package in accordance with claim 9 wherein said limitor means comprises an edge portion of said skirt projecting beyond adjacent portions of the edge of the skirt and which provides a threading stop upon abutment with a portion of said circumferential container flange.

12. A sealed package in accordance with claim 9 wherein said closure is provided with a dished central cover portion which is spaced inwardly of said lip, and which is capable of assuming an inwardly dished or outwardly dished configuration when subjected to a pressure differential between the package interior and ambient atmosphere.

13. A one-piece reusable closure for a container having a body portion, a circumferential flange extending outwardly from said body portion, and an upwardly extending neck portion which terminates in an upper circumferential sealing lip and defines a mouth and which has a helical container thread means on the outer surface of said neck portion above said flange; said closure comprising: a central cover section having an inner surface and an outer surface and a depending peripheral skirt having helical skirt thread means for threadingly engaging the container thread of a container; an annular gasket comprising a resilient, compressible closed cell foam resilient at temperatures up to about 250° F. at the periphery of said central cover section for confronting the periphery of a said sealing lip; a limitor means integral with an edge of said skirt for limiting the extent of threaded engagement with said container thread means whereby compression of said gasket against said lip is limited to a predetermined degree; and a portion of said central cover section being outwardly dished, but being movable under pressure, to an inwardly dished configuration and capable of generating an audible sound upon movement.

14. A sealed package under vacuum comprising a container having a body portion, a circumferential flange extending outwardly from said container, and an upwardly-extending neck portion which terminates in an upper circumferential sealing lip and defines a mouth; helical container thread means on the outer surface of said neck portion above said flange; and a one-piece reusable closure threadedly engaging said neck portion and sealingly secured to said container; said closure comprising a central cover section having an inner surface and an outer surface and terminating outwardly in a depending peripheral skirt having helical skirt thread means complementary to and in threaded engagement with said container thread means, an annular gasket bonded to the inner surface of said closure adjacent to said skirt and being in sealing engagement with said lip around the entire periphery of said lip, and an edge portion of said skirt projecting beyond adjacent portions of the edge of the skirt and having thereon a resilient bead, said bead presenting an undulating surface adapted for intermittent abutment with portions of said cirumferential container flange and providing a threading stop for limiting the extent of threaded engagement by said closure with said container thread means whereby compression of gasket material against said lip is limited to a predetermined degree.

15. A method of canning comprising the steps of: providing a container having an upper circumferential sealing lip which defines a mouth and having container thread means in the vicinity of the mouth; providing a one-piece closure comprising a flexible, outwardly-dished central cover section terminating outwardly in a depending peripheral threaded skirt for threadingly engaging said container thread means, said closure having an annular gasket bonded to said closure adjacent said skirt, said gasket comprising closed-cell foam material resilient at temperatures up to about 250° F. for compression against, and sealingly engaging, said lip around the periphery of the entire lip, said closure having limitor means displaced from said gasket for limiting the extent of threaded engagement with said thread means; filling the container with a desired quantity of product to be canned; threadingly securing said one-piece closure to said container to form a seal between said gasket and said lip and until said limiting thread engagement is reached so as to limit the maximum extent of gasket compression and to thereby seal said product within said container together with a small volume of gas; then heating said container and said product contained therein to a predetermined elevated temperature and thereby generating within the sealed container pressure sufficient to break the seal between the gasket and the container and to vent at least a portion of said gas volume to the surrounding atmosphere; then cooling said container and thereby re-effecting the seal between said gasket and said lip without further manipulation of said closure so as to maintain a subatmospheric pressure in said container.

16. A method in accordance with claim 15 wherein said limitor means is in said skirt.

17. A method in accordance with claim 16 which includes drawing said central cover portion into a downwardly dished configuration while developing a partial vacuum in said container.

18. A method in accordance with claim 16 in which said one-piece closure is one which has previously been used to seal a container.

19. A method of canning comprising the steps of: providing a container having an upper circumferential sealing lip which defines a mouth and having container thread means in the vicinity of the mouth and having a circumferential flange extending outwardly from said container below said container thread means; providing a one-piece closure comprising a flexible, outwardly-dished central cover section terminating outwardly in a depending peripheral threaded skirt for threadingly engaging said container thread means, said closure having an annular gasket bonded to said closure adjacent said closure skirt, said gasket comprising closed-cell foam material resilient at temperatures up to about 250° F. for compression by, and sealingly engaging, said lip around the entire lip, said closure having limitor means integral with an edge of said skirt for limiting the extent of threaded engagement with said container thread means; filling the container with a suitable quantity of product to be canned; threadingly securing said one-piece closure to said container to form a seal between said gasket and said lip and compressing said gasket until said limiting thread engagement is reached so as to limit the amount of gasket compression and to thereby seal said product within said container together with a small volume of gas; then heating said container and said product contained therein to a predetermined elevated temperature effective to prevent spoilage of said product and thereby generating pressure therein to force a portion of said contained gas to break the seal between the gasket and the container by compressing said gasket to vent said gas under gasket to the surrounding atmosphere; then cooling said container and thereby re-effecting the seal between said gasket and said lip without further manipulation of said closure so as to maintain a subatmospheric pressure in said container.

20. A method in accordance with claim 19 which includes drawing said central portion into a downwardly dished configuration while developing a partial vacuum in said container.

21. A method in accordance with claim 19 in which said one-piece closure is one which has previously been used to seal a container.

* * * * *